United States Patent [19]

Ochiai et al.

[11] Patent Number: 4,898,232

[45] Date of Patent: Feb. 6, 1990

[54] HEAT EXCHANGER AND PROCESS FOR PRODUCING THE SAME

[75] Inventors: Izumi Ochiai; Masahiro Miyagi; Yoshio Nozawa, all of Tochigi; Yukio Kitayama, deceased, late of Oyama, all of Japan, by Yuko Kitayama, Midori Kitayama, Takahisha Kitayama, successors

[73] Assignee: Hitachi, Ltd., Tokyo, Japan

[21] Appl. No.: 178,610

[22] Filed: Apr. 7, 1988

[30] Foreign Application Priority Data

Apr. 8, 1987 [JP] Japan ..... 62-84711

[51] Int. Cl.[4] ..... F28D 1/04

[52] U.S. Cl. ..... 165/151; 29/890.035

[58] Field of Search ..... 165/151, 148; 29/157.3, 29/157 A, 157.3 B

[56] References Cited

U.S. PATENT DOCUMENTS 3,780,799 12/1973 Pasternak ..... 165/151 X 3,815,672 6/1974 Bullard et al. ..... 165/151

*Primary Examiner*—Larry Jones

*Attorney, Agent, or Firm*—Antonelli, Terry & Wands

[57] ABSTRACT

A heat exchanger having different types of fins of different widths arranged such that different types of fins are arranged alternately can be efficiently produced by a process which has the steps of: forming a plurality of rows of refrigerant-tube holes in a hoop; forming lines of cutting which extend parallel to a direction of feed of the hoop at positions which are offset from the midpoint between adjacent rows of the holes, the lines of cutting having a length smaller than the longitudinal size of fins to be obtained; forming slits or elongated holes in positions of the hoop to which the ends of the lines of cutting is to be extended, the slits or elongated holes having longitudinal axes extending in the direction crossing the direction of feed of the hoop; cutting the hoop along a transverse line of cutting which extends in the direction crossing the direction of feed of the hoop past regions between adjacent slits or elongated holes which oppose to each other in the direction of feed of the hoop, thus severing a group of fins having a plurality of fins of different types connected integrally; stacking the successively severed groups of fins; inserting refrigerant tubes into the holes in the fins and expanding the tubes so as to fix the tubes to the fins in the successive groups; and cutting the stacked successive groups of fins at positions between adjacent rows of the holes and within the regions of the slits or the elongated holes.

10 Claims, 7 Drawing Sheets

HEAT EXCHANGER AND PROCESS FOR PRODUCING THE SAME

BACKGROUND OF THE INVENTION

The present invention relates to a heat exchanger and a process for producing the same. More specifically, the invention is concerned with a heat exchanger which experiences reduced deterioration in performance attributable to frosting and which can be produced with a high production efficiency.

Heat exchangers have been proposed to reduce the deterioration in performance attributable to frosting. An example of such heat exchangers is shown in Japanese Utility Model Unexamined Publication No. 50-122054. In this heat exchanger, the widths of fins are varied to be zigzag at the air inlet side of the heat exchanger so as to reduce the obstruction against the flow of air caused by frost which is formed heavily specifically at the inlet ends of the fins.

This known heat exchanger will be described hereinunder with reference to FIG. 9 which is a perspective view of the zigzag arrangement of this heat exchanger. As illustrated, the heat exchanger has a multiplicity of fins 7, 8 penetrated by heat exchanger tubes 1 which may be refrigerant tubes 1, and air flows into this heat exchanger in the direction of an arrow A. More specifically, the fins are grouped into two types: namely, fins 7 which have a greater width L2 and, hence, a greater distance between the end face 7*a* and the refrigerant tube 1, and fins 8 which have a smaller width L3 and, hence, a smaller distance between the end face 8*a* and the refrigerant tube 1. These two types of fins 7, 8 are arranged alternately and are fixed to the tubes 1.

The heat exchanger as shown in FIG. 9 can be produced by, for example, a process disclosed in Japanese Patent Unexamined Publication No. 58-110142. This process will be explained with reference to FIG. 10 which is a perspective view showing this process. A wide hoop 12 is fed in the direction of an arrow B and is cut by a press having cutting blades 10, 10*a* which are arranged such that pairs of wide fin 7 and narrow fin 8 are formed in a side-by-side fashion, along longitudinal lines 9, 9*a* of cutting. Then, the wide fin 7 and the narrow fin 8 are severed along a transverse line 11 by a cutting blade 15. A jig 14 having pins 13 receives the thus severed wide and narrow fins 7, 8 falling thereonto, with its pins 13 inserted in the refrigerant tube holes 16 formed in the respective fins, whereby the wide and narrow fins 7, 8 are stacked alternately.

In this type of heat exchanger, the deterioration of performance due to frosting is remarkably suppressed, but the efficiency of production of this type of heat exchanger is low because of the process for preparing and alternately stacking two types of fins of different widths as illustrated in FIG. 10.

The described process also suffers from a disadvantage in that, particularly when the fin of the heat exchanger is of narrow type having a single row of refrigerant tubes as shown in FIGS. 9 and 10, the refrigerant-tube holes on the fins 7, 8 cannot correctly catch and receive the pins 13 on the jig 14 so as to hinder the production, with the result that the production efficiency is impaired. This is attributable to the fact that the centroid or center of mass of one of the fins 7, 8 does not coincide with the position of the hole, due to variance in the distance between the fin end and the tube (hole).

SUMMARY OF THE INVENTION

Accordingly, an object of the invention is to provide a heat exchanger having wide fins and narrow fins which are arranged alternately, and a process which makes it possible to produce such a heat exchanger at a high efficiency.

To this end, according to one aspect of the present invention, there is provided a heat exchanger having heat exchanger tube(s) and different types of fins of different widths arranged such that different types of fins are arranged alternately in the longitudinal directions of the tube(s), characterized in that each of the fins are notched in the direction perpendicular to a longitudinal direction or axis of each fin at portions near both longitudinal ends thereof, and the widths of the different types of fins are equal at both longitudinal end portions of the fins outside the notches.

According to another aspect of the present invention, there is provided a process for producing a heat exchanger comprising the steps of: forming a plurality of rows of refrigerant-tube holes in a hoop or web-like member; forming lines of cutting which extend parallel to a direction of feed of the hoop at positions which are offset from the midpoint between adjacent rows of the holes, the lines of cutting having a length smaller than the longitudinal size of fins to be obtained; forming slits or elongated holes in positions of the hoop to which the ends of the lines of cutting are to be extended, the slits or elongated holes having longitudinal axes extending in the direction crossing the direction of feed of the hoop; cutting the hoop along a transverse line of cutting which extends in the direction crossing the direction of feed of the hoop past regions between adjacent slits or elongated holes which oppose each other in the direction of feed of the hoop, thus severing a group of fins having a plurality of fins of different types connected integrally; stacking the successively severed groups of fins; inserting refrigerant tubes into the holes in the fins and expanding the tubes so as to fix the tubes to the fins in the successive groups; and cutting the stacked successive groups of fins at positions between adjacent rows of the holes and within the regions of the slits or the elongated holes.

In the production process of the invention, the hoop is cut along the lines of cutting parallel to the longitudinal axis of the hoop so as to define a plurality of fin portions of different widths in the direction of width of the hoop. These fin portions, however, are still held or connected integrally because the portions of the hoop which are outside the respective slits or elongated holes corresponding to the notches in the finished fins are not cut apart. It is therefore possible to obtain groups of fins having a plurality of fins connected in the direction of width of the hoop, so that a stack of fins can be prepared with a high efficiency. The successive groups of fins are transferred through the press and are made to fall onto the jig having pins. This eliminates the problem encountered with the known method in which independent fins are stacked, namely, the deviation of the centroids of the fins due to variation of fin widths and interference between the edges of the holes and the pins.

The integrality of the fin group is maintained at the connecting regions which are present at both longitudinal ends of the fin portions. After the assembly, the fin group is cut at these connecting regions, whereby the assembly is separated into a plurality of heat exchangers.

In the heat exchanger thus produced, both types of fins which are adjacent to each other have the same size in the widthwise direction at both longitudinal end regions of these fins. This, however, does not cause any substantial problem because these regions are very short and disposed only at longitudinal ends of the fins.

Thus, the performance of this heat exchanger is substantially the same as that of known heat exchangers in which the ends of the fins are in a zigzag staggered pattern at the air inlet side over the entire length of the fins.

The insertion and expansion of the refrigerant tubes in the holes is preferably conducted in advance of the cutting at the positions between adjacent rows of holes, although the insertion and expansion of the tubes may be conducted after the cutting.

It is also preferred that the slits or elongated holes are formed after the formation of the associated lines of cutting parallel to the direction of feed of the hoop, though the formation of the slits or elongated holes may be executed prior to the formation of the associated lines of cutting parallel to the direction of feed of the hoop.

The positions between adjacent rows of holes to be cut at longitudinal ends of the fins are usually on longitudinal lines substantially midst between the adjacent rows, although they may be offset from the longitudinal lines midst between the rows of holes.

These and other objects, features and advantages of the present invention will become clear from the following description of the preferred embodiments when the same is made in conjunction with the accompanying drawings.

DESCRIPTION OF THE PREFERRED EMBODIMENTS

Figure 1:
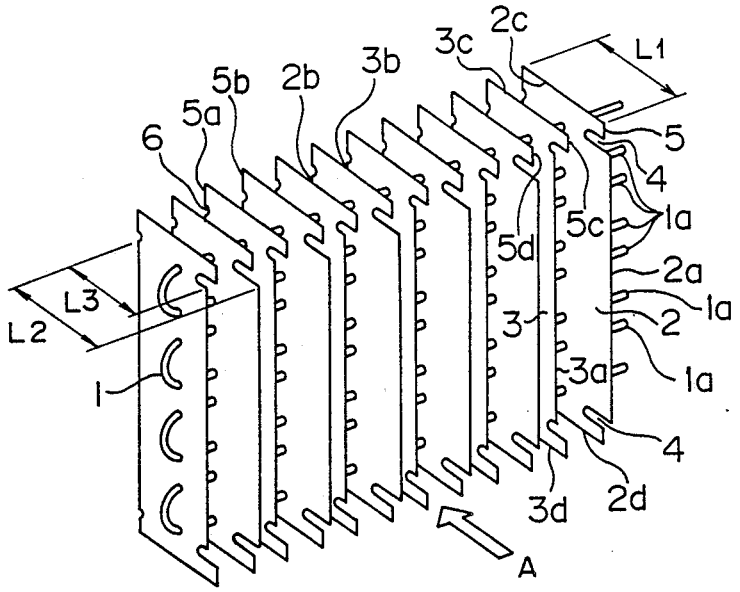
FIG. 1 is a perspective view of an embodiment of the heat exchanger in accordance with the present invention.
Figure 9:
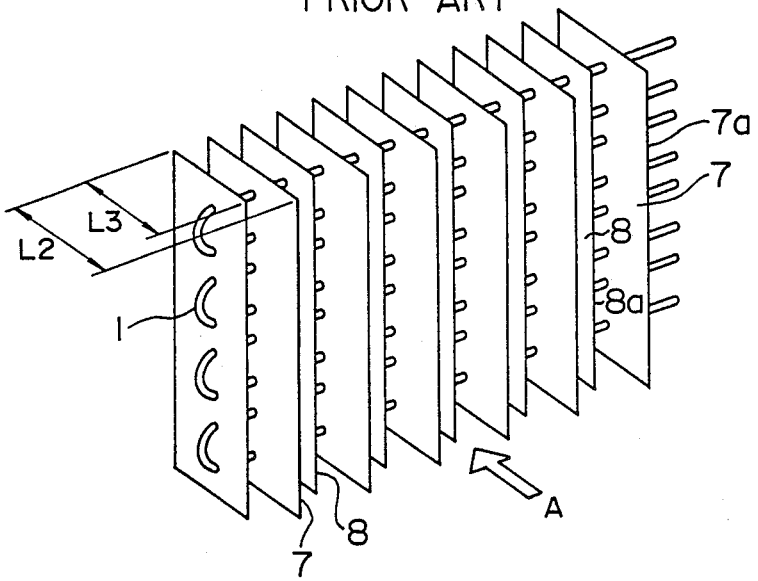
FIG. 9 PRIOR ART
FIG. 9 is a perspective illustration of a known heat exchanger.

FIG. 1 is a perspective view of a heat exchanger embodying the present invention. The heat exchanger has fins 2 and 3 fixed to refrigerant tubes 1. Ends 1*a* of the tubes 1 can be connected to form a single cotinuous tube. Air flows into this heat exchanger in the direction of an arrow A. The fin 2 is so constructed that its end face 2*a* is largely or remotely spaced from the refrigerant tube 1, while the fin 3 is so constructed that the distance between its end face 3*a* and the refrigerant tube 1 is comparatively small. The fins 2 and 3 are arranged alternately. During operation of the heat exchanger, frosting takes place on the air inlet ends of the fins 2 and 3. The impediment to the flow of air caused by the frosting, however, is not so serious because the end surfaces 2*a* and 3*a* are arranged in a staggered or zigzag manner.

The fin 2 is provided in the end face 2*a* thereof with notches 4 which are slightly spaced from both longitudinal ends 2*c*, 2*d*, such that a small severance protrusion 5 is formed on the outer side of each notch 4 as viewed in the longitudinal direction of the fin 2. Similar notches 4 are also formed in the other type of fin 3. The distance between the end face of the protrusion 5 and the refrigerant pipe 1 in the fin 2 is the same as that in the fin 3. The frosting may take place rather heavily on the ends of the protrusions 5 because these ends of the adjacent fins are disposed close to each other. This, however, does not materially affect the performance of the heat exchanger because the protrusions 5 have only a small length in the longitudinal direction of fins 2, 3 and because these protrusions 5 are disposed only in the upper and lower limited portions of the heat exchanger. Each fin is also provided with notches 6 which are formed in the other end face of thereof at positions close to the longitudinal ends 2*c*, 2*d* and 3*c*, 3*d* thereof, such that severed protrusions 5*a*, 5*b* are formed between the ends 2*c*(2*d*), 3*c*(3*d*) and the notch 6. The widths of the fins 2, 3 as measured at the ends having the protrusions 5*a*, 5*b* are the same, as represented by L1 ($L3<L1<L2$).

Figure 2:
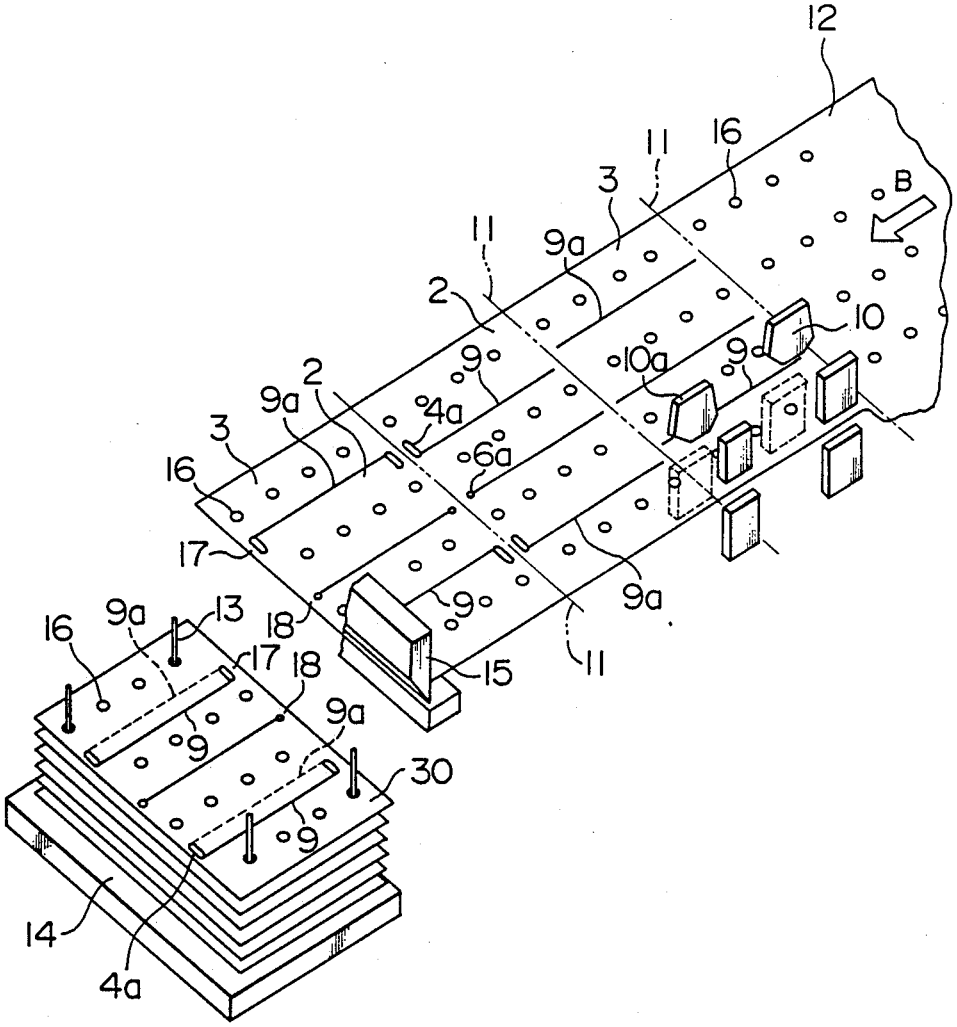
FIG. 2 is a schematic illustration of a process for producing fins used in the heat exchanger of FIG. 1.

A description will be made hereinafter, with specific reference to FIGS. 2 to 5, as to a process of producing the heat exchanger shown in FIG. 1. FIG. 2 is a perspective view illustrating the production process. Four fins including two wide fins and two narrow fins arranged alternately are successively severed from a continuous hoop or metallic web-like member 12. Thus, fins are still connected at the junctures 17, 18 between the portions which will become severance protrusions 5, 5*a* after severance, i.e., portions outside elongated holes 4*a* and holes 6*a*. Namely, as the hoop 12 is fed in the direction of an arrow B, the hoop 12 is cut along lines 9, 9*a* which define the longitudinal sides 2*a*, 2*b*, 3*a*, 3*b* the fins 2, 3, such that four fins including two wide fins 2 and two narrow fins 3 are formed in a side-by-side fashion such that the wide fin 2 and the narrow fin 3 appear alternately in the breadthwise direction of the hoop, but these four fins are still unitary or integral because the lines 9, 9*a* of cutting do not extend beyond the elongated holes 4 which are bound to constitute the notches 4 after the severance. Thus, fin groups each having four fins are successively formed by press or punching as the hoop 12 is fed in the direction of the arrow B. The successive groups of fins after the press work are then severed by a cutting blade 15 along a line 11 which extends in the direction perpendicular to the direction B of feed of the hoop 12 and which passes regions between two adjacent elongated holes 4a, 4a of the successive groups. Thus, independent groups 30 of fins, each consisting of four fins 2, 3 unitarily connected in the direction of breadth of the hoop 12, fall onto a jig 14 and are automatically stacked one on the other such that the refrigerant tube holes 16 in the respective fins receive the pins 13. The stacking can be accomplished without substantial difficulty because each fin group 30 consisting of four fins before severance is wide and falls regularly or stably. Spacing between adjacent fin groups 30 is provide by cylindrical burrs rise 30a (refer to FIGS. 3 to 5, or FIG. 4 in particular) left around the holes 16.

Figure 10:
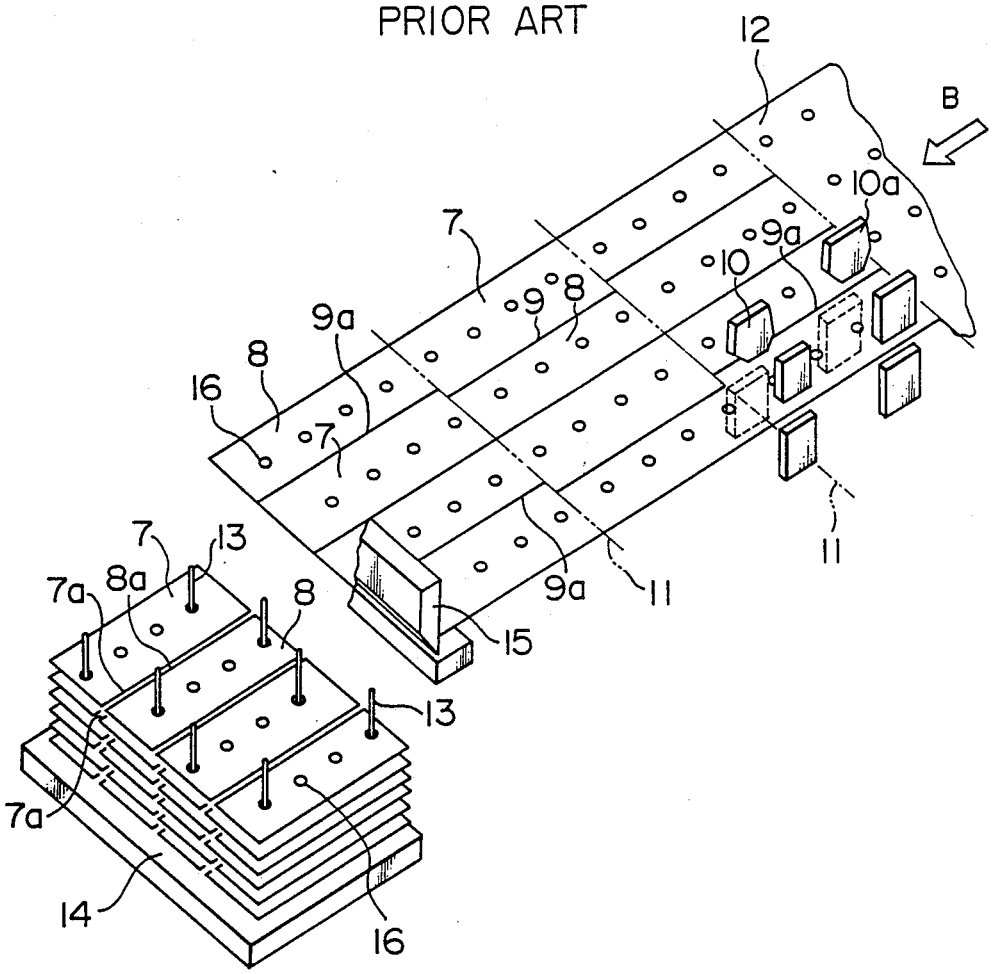
FIG. 10 PRIOR ART
FIG. 10 is a schematic illustration of a process for producing the known heat exchanger of FIG. 9.

In the press work explained above, a pair of cutting blades 10 and 10a of the press operate alternately to form the lines 9, 9a of cutting respectively in the successive groups of fins 30. Thus, in the stack of the fin groups 30 on the jig 14, the positions of lines 9, 9a of cutting are staggered. For instance, the line 9 of cutting formed by the cutting blade 10 in the uppermost fin group 30 is positioned adjacent to the line 9a (shown by broken line) formed by the cutting blade 10a in the underlying fin group 30. Thus, the distance between the refrigerant tube holes 16 and the longitudinal side face of the fin between both elongated holes 4a, 4a constituted by the lines 9, 9a of cutting, alternately varies in the stacking direction. In the illustrated embodiment, holes 4a, 6a have been formed after the formation of the lines 9, 9a of cutting. The lines 9, 9a of cutting may be formed after the formation of the holes 4a, 6a. Thus, in the process of the invention, the stack is formed by successive groups of fins 30 each including four fins which are connected at portions 17, 18, in contrast to the known process shown in FIG. 10 in which independent fins 7, 8 of two different types were successively and alternately stacked. In the known process, there is a problem that the stacking is impeded due to the fact that the fins 7, 8, 9 of different types wave in different forms. In the process of the invention, however, this problem is overcome because the successive groups 30 of fins exhibit the same tendency of waving, if any. When the heat exchanger is designed for unidirectional flow of air, the longitudinal sides of two types of fins may registered at the air outlet side of the heat exchanger, i.e., the distance between the outlet side ends 2b, 3b of the fins 2, 3 and the refrigerant tubes 1 may be the same. For this reason, the positions of the junction 18 in the successive groups 30 of the fins in the stack are vertically aligned.

Figure 6:
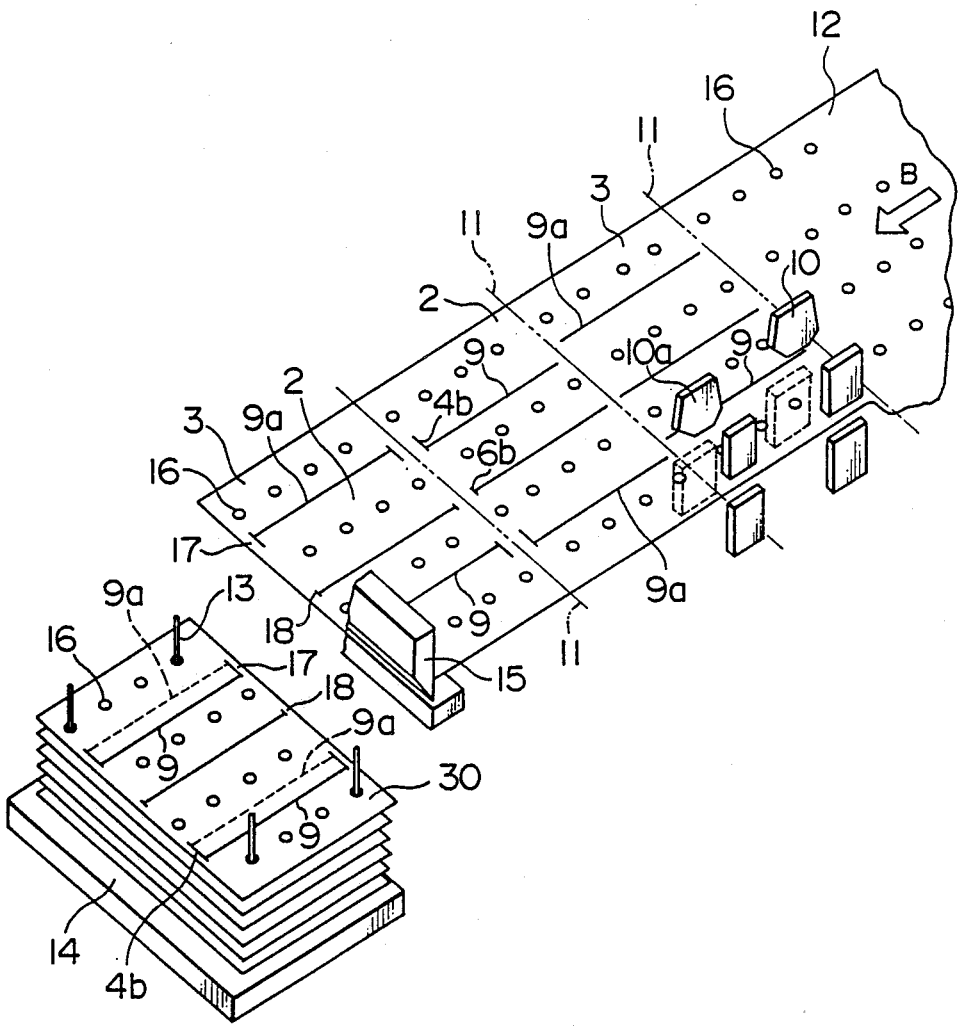
FIG. 6 is an illustration of another embodiment of the process of the invention showing particularly the production of fins.

The elongated holes 4a and the holes 6a in the described embodiment may be substituted by slits 4b, 6b as shown in FIG. 6.

It will be understood that, in the described embodiment, the lines 9, 9a of cutting do not cross or intersect the line 11 of cutting because of the presence of the connecting portions 17, 18. When the hoop 12 as the blank material of the fins has high mechanical strength and rigidity, however, the lines of cutting 9, 9a may reach the line 11 of cutting at one of their two ends.

The group or array 30 of fins may be composed of any suitable even number of fins, e.g., two or 6 or more, though the fin group 30 in the described embodiment is constituted by four fins.

Figure 7:
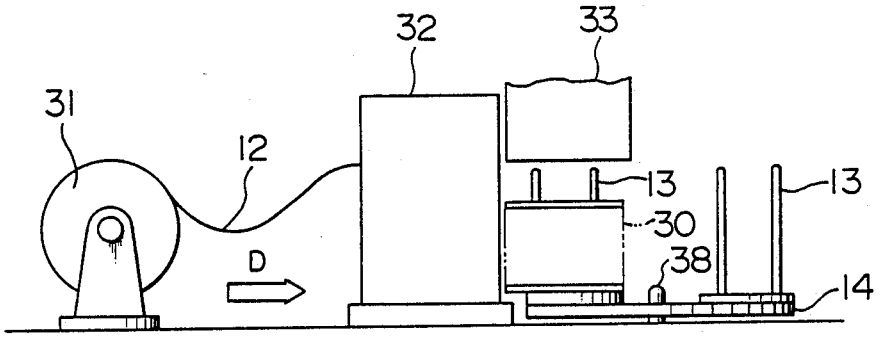
FIG. 7 is an illustration of a fin production apparatus suitable for use in a fin production process in an embodiment of the process according to the present invention.

FIG. 7 shows an embodiment of an apparatus for carrying out the process of the present invention in which the hoop 12 is unrolled from a roll 31 and is subjected to processings performed by the cutting blades 10, 10a and 15 of the press 32, whereby successive fin groups 30 are obtained. These fin groups 30 are successively picked up by a vacuum unit or suction-type lifter 33 and is moved to a position where the holes 16 in the fins are aligned with the pins 13 of the jig 14 in the vertical direction. The vacuum unit then releases the fin group 30 so that the latter fall onto the jig 14 with the holes receiving the pins 13 on the jig 14.

Figure 8:
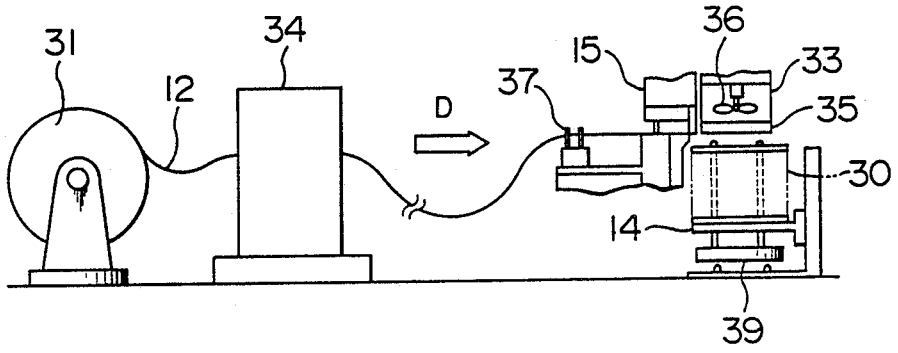
FIG. 8 is an illustration of another fin production apparatus suitable for use in a fin production process in an embodiment of the process according to the present invention.

FIG. 8 shows another embodiment of an apparatus for carrying out the process of the present invention in which the hoop 12 is unrolled from a roll 31 and is subjected to processings performed by the cutting blades 10, and 10a of the press 34, and the leading end portion of the hoop 12 of a predetermined length is held by a suction plate 35 of a vacuum unit or suction-type lifter 33 having a propeller fan 36. Then, the trailing end of the hoop portion held by the lifter 33 is cut by a cutting blade 15 which is disposed at the downstream side of a feeder 37 as viewed in the direction D of movement of the hoop 12, whereby the group 30 of fins is severed. The arrangement may be such that a pair of jigs 14 are mounted on a turn table rotatable around a shaft 38 as shown in FIG. 7, or such that the jig 14 is carried by a mobile truck 39.

Figure 3:
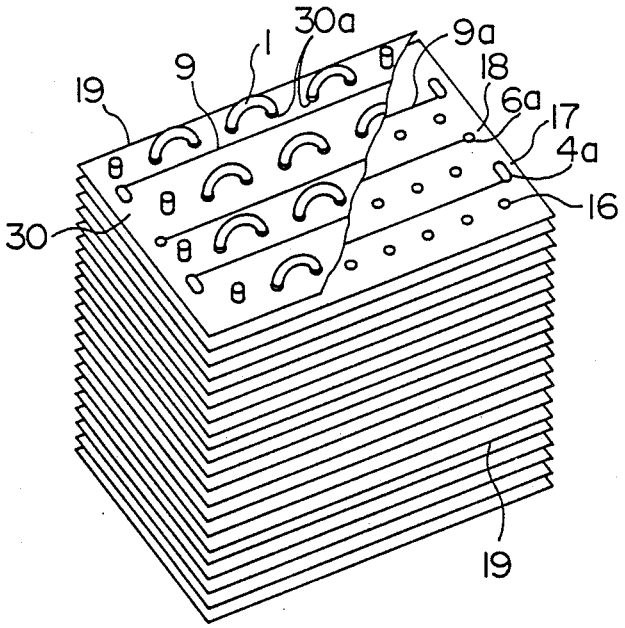
FIG. 3 is a perspective illustration of an intermediate step of an embodiment of a method of the invention for producing a heat exchanger.

FIG. 3 shows an intermediate step of the assembly process in which a plurality of fin groups 30 dismounted from the jig 14 are handled as a block and the refrigerant tubes 1 are inserted into the holes in the respective fins of the fin groups 30. The tubes are then fixed to the fins by a tube expansion technique which is known per se. During the expansion, the fin groups 30 constituting the block are held and pressed at their ends 19. The pressing of these end surfaces, however, does not cause any substantial problem such as deformation or breakage of the fins because the end surfaces 19 are vertically aligned. Thus, the insertion of the refrigerant tubes, assembly and tube expansion can be effected easily and securely.

Figure 4:
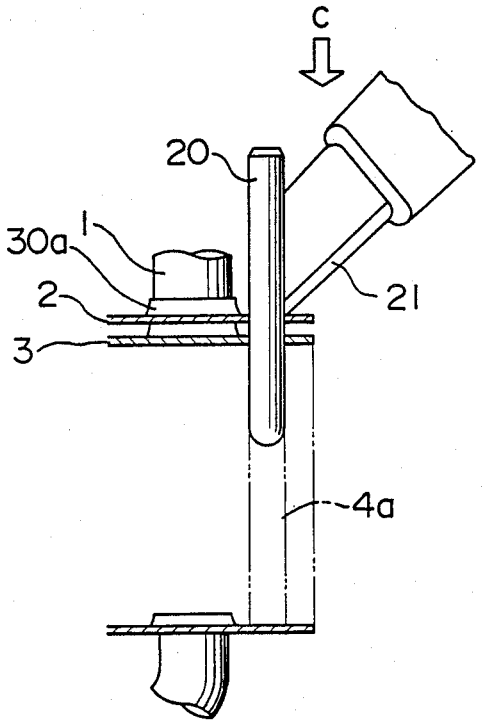
FIG. 4 is a partial sectional view of an intermediate processing state in an embodiment of the process of the invention.
Figure 5:
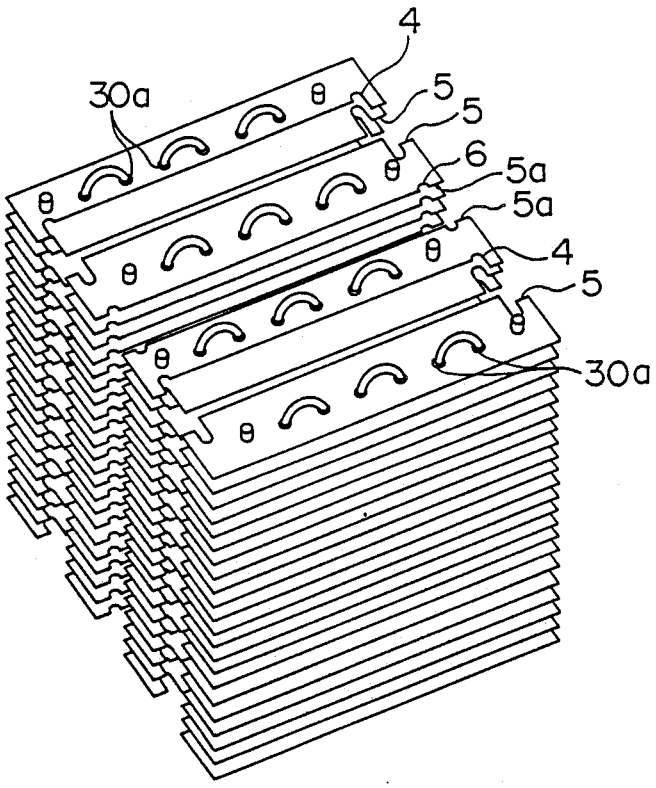
FIG. 5 is a perspective illustration of heat exchangers which have been produced by a production process of the present invention.

FIG. 4 shows a step of the separation process in which the block of fin groups 30 with the refrigerant tubes 1 fixed in their holes 16 is cut by a cutting device so as to form a plurality of heat exchangers. The cutting device has a cutting blade 21 and a guide pin 20 received in and guided by the elongated holes 4a or holes 6a. The cutting blade 21 is then moved downward as indicated by an arrow C while the guide pin 20 is guided by the vertical row of elongated holes 4a so that the connecting portions 17, 18 are cut to sever the fins of each of groups 30 in the block, whereby four heat exchangers each being of the type shown in FIG. 1 are obtained, as will be seen from FIG. 5. When the elongated holes 4a are substituted by slits as shown in FIG. 6, the guide pin 20 of the cutting device may be omitted.

Thus, according to the invention, heat exchangers of the type shown in FIG. 1 can be stably and readily produced by the process explained with reference to attached drawings by virtue of the provision of notches 4 and the severance protrusion 5 of a uniform distance from the refrigerant tubes 1 in each of the successive fins.

What is claimed is:

1. A heat exchanger comprising:

first and second types of fins stacked alternately with respect to each other;

each of first and second types of fins having notches in a direction perpendicular to a longitudinal direction of each said fin near longitudinal ends thereof;

widths of said first and second types of fins being equal at both longitudinal end portions of said first and second fins in outer areas defined by said notches thereof;

each of the first type of fins having a width at a portion between the notches greater than the width at the both longitudinal end portions thereof on the outer areas defined by said notches; and at least one heat exchanger tube penetrating through the alternately stacked first and second types of fins.

2. A heat exchanger according to claim 1, wherein the longitudinal end portions form protrusions from the notches of said fins such that the distance between end faces of the protrusions of said different types of fins to the at least one tube is the same.

3. A heat exchanger having at least one heat exchanger tube and fins of different widths arranged alternately in a longitudinal direction of the at least one heat exchanger tube, and means arranged at longitudinal end regions of said fins at different widths for defining notches on said fins such that the distance between said means of said fins of different width and the at least one heat exchanger tube are the same and the widths of the fins of different width are equal at both longitudinal end regions in outer areas defined by said notches.

4. A method of producing a heat exchanger comprising the steps of:

forming a plurality of rows of refrigerant-tube holes in a hoop;

forming lines of cutting which extend parallel to a direction of feed of said hoop at positions which are offset from the midpoint between adjacent rows of said holes, said lines of cutting having a length smaller than the longitudinal size of fins to be obtained;

forming slits or elongated holes in positions of said hoop to which the ends of said lines of cutting is to be extended, said slits or elongated holes having longitudinal axes extending in the direction crossing the direction of feed of said hoop;

cutting said hoop along a transverse line of cutting which extends in the direction crossing the direction of feed of said hoop past region between adjacent slits or elongated holes which oppose to each other in the direction of feed of said hoop, thus severing a group of fins having a plurality of fins of different types connected integrally;

stacking the successively severed groups of fins;

inserting refrigerant tubes into said holes in said fins and expanding said tubes so as to fix said tubes to said fins in the successive groups; and cutting the stacked successive groups of fins at positions between adjacent rows of said holes and within the regions of said slits or said elongated holes.

5. A method according to claim 4, wherein the cutting longitudinal ends of the fins at positions between adjacent rows of holes is conducted after the insertion and expansion of said refrigerant tube.

6. A method according to claim 4, wherein the cutting longitudinal ends of the fins at positions between adjacent rows of holes is conducted before the insertion and expansion of said refrigerant tube.

7. A method according to claim 4, wherein said slits or elongated holes are formed in advance of formation of the associate lines of cutting parallel to the direction of feed of said hoop.

8. A method according to claim 4, wherein said slits or elongated holes are formed after the formation of the associate lines of cutting parallel to the direction of feed of said hoop.

9. A method according to claim 4, wherein said positions between adjacent rows of holes to be cut at longitudinal ends of the fins are on longitudinal lines substantially midst between the adjacent rows of holes.

10. A method according to claim 4, wherein said positions between adjacent rows of holes to be cut at longitudinal ends of the fins are offset from longitudinal lines midst between said rows of holes.

* * * * *